US007377241B2

(12) United States Patent
Hirano

(10) Patent No.: US 7,377,241 B2
(45) Date of Patent: May 27, 2008

(54) VALVE OPERATING SYSTEM FOR INTERNAL COMBUSTION ENGINE

(75) Inventor: Makoto Hirano, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/406,235

(22) Filed: Apr. 19, 2006

(65) Prior Publication Data

US 2006/0254545 A1 Nov. 16, 2006

(30) Foreign Application Priority Data

Apr. 19, 2005 (JP) ..... 2005-120732

(51) Int. Cl.
*F01L 1/34* (2006.01)

(52) U.S. Cl. ..... 123/90.16; 123/90.15; 123/90.39

(58) Field of Classification Search ..... 123/90.16, 123/90.15, 90.39, 90.17
See application file for complete search history.

(56) References Cited

U.S. PATENT DOCUMENTS 5,553,584 A * 9/1996 Konno ..... 123/90.16
5,975,036 A * 11/1999 Hayashi et al. ..... 123/90.16
2002/0157623 A1* 10/2002 Turner et al. ..... 123/90.12

FOREIGN PATENT DOCUMENTS

JP 63170512 A * 7/1988
JP 63-285207 A 11/1988

* cited by examiner

*Primary Examiner*—Zelalem Eshete
(74) *Attorney, Agent, or Firm*—Birch, Stewart, Kolasch & Birch, LLP

(57) ABSTRACT

In a valve operating system for an internal combustion engine provided with valve operating characteristics changing member capable of changing operating characteristics of an engine valve, the valve operating characteristics changing member includes a connection operating member which is provided in common at a drive rocker arm and both free rocker arms to be capable of switching an alternative connecting state of the drive rocker arm to both the free rocker arms and a release state of connection of the drive rocker arms to both the free rocker arms. Thus, the operating characteristics of the engine valve can be reliably switched with favorable responsiveness.

23 Claims, 9 Drawing Sheets

VALVE OPERATING SYSTEM FOR INTERNAL COMBUSTION ENGINE

CROSS-REFERENCE TO RELATED APPLICATIONS

The Japanese priority application No. 2005-120732 filed on Apr. 19, 2005 upon which the present application is based is hereby incorporated in its entirety herein by reference.

BACKGROUND OF THE INVENTION

1. Field of the Invention

The present invention relates to a valve operating system for an internal combustion engine in which a pair of free rocker arms, which are capable of being free with respect to an engine valve, and a drive rocker arm, which is linked and connected to the engine valve and sandwiched between both of the free rocker arms, are swingably supported at a rocker arm shaft which is common to both the free rocker arms and the drive rocker arm. A camshaft is provided which rotates around an axis parallel with the rocker arm shaft and is provided with a plurality of cams including cams individually corresponding to both the free rocker arms by making cam profiles differ from each other. The drive rocker arm and both the free rocker arms are provided with valve operating characteristics changing means capable of changing the operational characteristics of the engine valve by switching the connection of the drive rocker arm to both the free rocker arms and releasing the connection.

2. Description of the Related Art

Japanese Patent Application Laid-open No. 63-285207 discloses a valve operating system for an internal combustion engine in which the drive rocker arm linked and connected to the engine valve is disposed to be sandwiched between a pair of free rocker arms capable of being free from the engine valve, a hydraulic connection switching means is provided to make it possible to switch the connection of the drive rocker arm and the free rocker arm and release of connection by the operation of the connecting pin, said hydraulic connection switching means being respectively provided between the drive rocker arm and one of the free rocker arms, and between the drive rocker arm and the other free rocker arm.

However, in the valve operating system disclosed in Japanese Patent Application Laid-open No. 63-285207, it is difficult in controlling the hydraulic circuit to perform a release of the connection and the connecting operation of a pair of connection switching means substantially at the same time on the occasion of switching the state in which the drive rocker arm is operated to swing with one of the free rocker arms to the state in which the drive rocker arm is swung with the other free rocker arm. In addition, there is the possibility of an occurrence of trouble of both of them being in the connection release state or the connecting state due to a variation or the like of the hydraulic pressure switching signal, or the occurrence of a problem wherein the connection pins of both of the connection switching means are in the same operation state at the same time irrespective of the switching signals due to an increase or the like in the frictional force exerted on the connection pin. If such a problem occurs, a desired valve operating characteristics cannot be obtained.

When both the connection switching means are operated by switching in sequence, the operation of one connection switching means has to be started after the completion of the operation of the other connection switching means is confirmed. Thus, a delay occurs with regard to the switching time.

SUMMARY OF THE INVENTION

The present invention is made in view of the above circumstances. It is an object of an embodiment of the present invention to provide a valve operating system for an internal combustion engine that is capable of reliably switching the operating characteristics of an engine valve with favorable responsiveness.

In order to achieve the above object, according to a first feature of an embodiment of the present invention, a valve operating system for an internal combustion engine is provided in which a pair of free rocker arms are capable of being free with respect to an engine valve, and a drive rocker arm, which is linked and connected to the engine valve and sandwiched between both the free rocker arms, are swingably supported at a rocker arm shaft which is common to both the free rocker arms and the drive rocker arm. A camshaft is provided which rotates around an axis parallel with the rocker arm shaft with a plurality of cams including cams individually corresponding to both the free rocker arms by making cam profiles that are different from each other. The drive rocker arm and both the free rocker arms are provided with valve operating characteristics changing means capable of changing the operational characteristics of the engine valve by switching the connection of the drive rocker arm to both the free rocker arms and releasing the connection. The valve operating characteristics changing means comprises a connection operating member which is provided in common at the drive rocker arm and both the free rocker arms to be capable of switching an alternative connecting state of the drive rocker arm to both the free rocker arms, and a release state of the connection of the drive rocker arm to both the free rocker arms.

According to a second feature of the present invention, in addition to the first feature, the system further comprises an operational restricting mechanism that switches a state in which the operational restricting mechanism engages with the connection operating member in the release state of the connection of the drive rocker arm to both the free rocker arms to keep the position of the connection operating member, and a state in which the operation restricting mechanism releases the engagement with the connection operating member to allow an operation of the connection operating member.

According to a third feature of the present invention, in addition to the first or second feature, in the drive rocker arm, an accommodation hole is provided which has opposite ends opened to both the free rocker arms and in which the connection operating member that is a pin is slidably fitted and is provided parallel with the rocker arm shaft and the cam shaft. Engaging holes in which opposite ends of the connection operating member are capable of being engaged, respectively, are provided in both the free rocker arms so as to be coaxial with the accommodation hole in a state in which the engine valve is in a closed state and both the free rocker arms abut on base circular portions of the corresponding cams.

According to a fourth feature of the present invention, in addition to the third feature, operational force exerting parts are capable of exerting an axial operation force in directions opposed to each other on the connection operating member and are, respectively, provided in both the free rocker arms.

According to a fifth feature of the present invention, in addition to the fourth feature, both the operational force exerting parts are constructed to exert hydraulic forces.

According to a sixth feature of the present invention, in addition to the fourth feature, one operational force exerting part is constructed to exert a hydraulic force, and the other operation force exerting part is constructed to exert a spring force.

According to a seventh feature of the present invention, in addition to any of the second to sixth features, the lengths in an axial direction of the connection operating member and the accommodation hole are set to be the same.

According to an eighth feature of the present invention, in addition to any of the first to seventh features, a cam corresponding to the drive rocker arm is provided in the camshaft.

According to a ninth feature of the present invention, in addition to the eighth feature, the cam corresponding to the drive rocker arm is formed to bring the engine valve into a valve closing and stopping state in the release state of the connection of the drive rocker arm to both the free rocker arm.

According to a tenth feature of the present invention, in addition to the eighth feature, a height of the cam corresponding to the drive rocker arm from a base circular portion is set to be smaller than the heights of the cams individually corresponding to both the free rocker arms from the base circular portions at a same crank angle.

According to an eleventh feature of the present invention, in addition to any of the first to tenth features, the cams individually corresponding to both the free rocker arms are formed to have a portion where one of the heights of the cams from the base circular portions becomes higher and a portion where the other one becomes higher in accordance with a change in the crank angle.

With any of the first to eleventh features of the present invention, the alternative connecting state of the drive rocker arm to both the free rocker arms and the release state of the connection of the drive rocker arm to both the free rocker arms are switched by the operation of the common connection operating member to the drive rocker arm and the free rocker arms. Therefore, it is possible to reliably switch the three states that are the states in which the drive rocker arm is alternatively connected to both the free rocker arms and the state in which the connection of the drive rocker arm to both the free rocker arms is released. In addition, it is not necessary to confirm the operation of the connection operating member, so that a delay does not occur to the switching time.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

FIGS. 1 to 8 show a first embodiment of the present invention.

Figure 1:
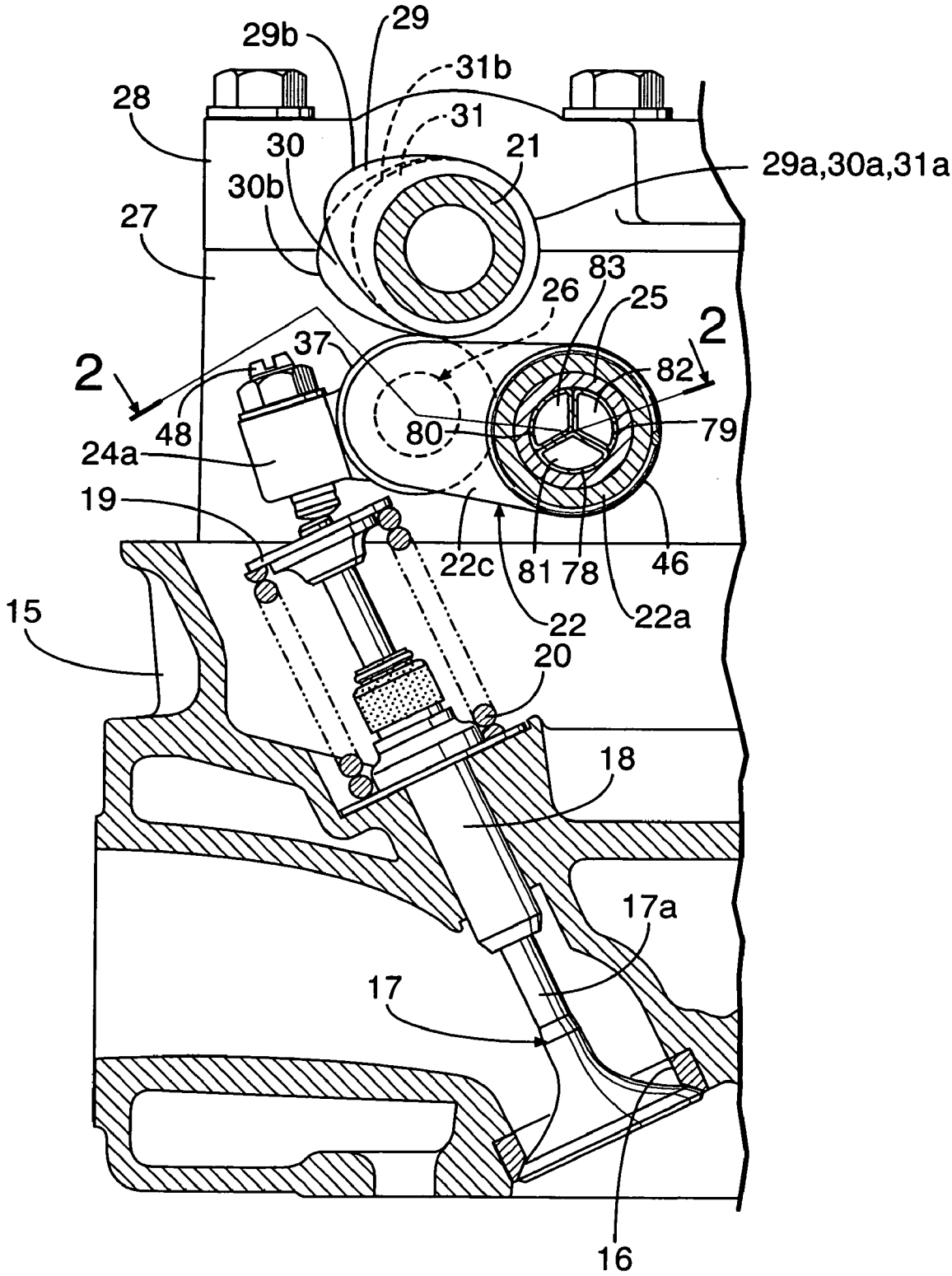
FIG. 1 is a vertical sectional side view of a valve operating system for an intake valve of a first embodiment, and a sectional view taken along the line 1-1 in FIG. 2.

As illustrated in FIG. 1, a pair of intake valve ports 16 is provided for each cylinder in a cylinder head 15 of an internal combustion engine. Both the intake valve ports 16 are individually opened and closed by intake valves 17 as engine valves, and stems 17*a* of these intake valves 17 are slidably fitted in guide cylinders 18 which are respectively provided in the cylinder head 15. Valve springs 20 which surround each of the stems 17*a* are provided between retainers 19 which are provided at upper end portions of the stems 17*a* projecting upwardly from the respective guide cylinders 18 and the cylinder head 15. The intake valves 17 are biased in the direction to close the intake valve ports 16 by the spring force of these valve springs 20.

Figure 2:
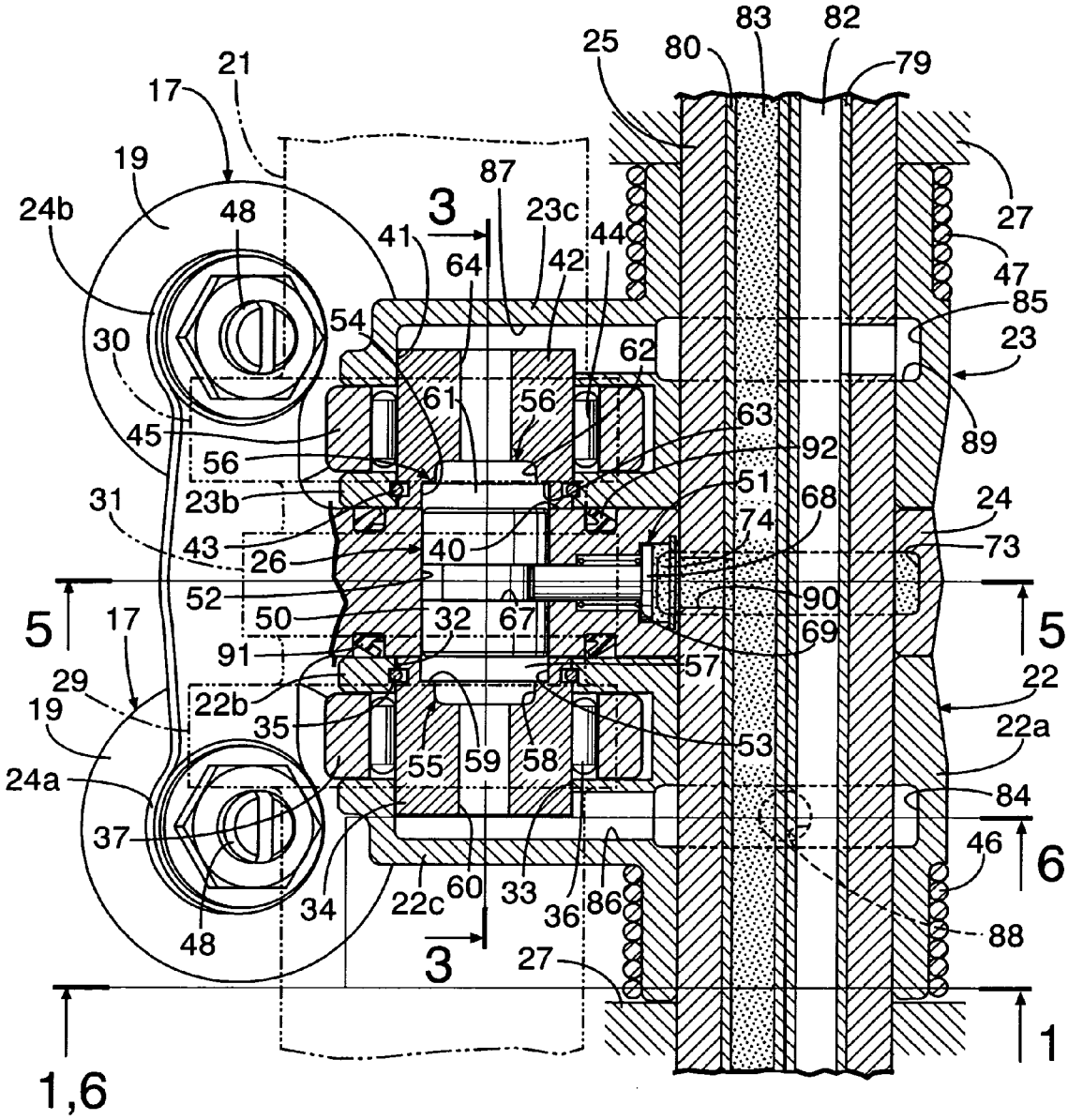
FIG. 2 is a sectional view taken along the line 2-2 in FIG. 1 in a state in which connection of a drive rocker arm and both free rocker arms is released.
Figure 3A:
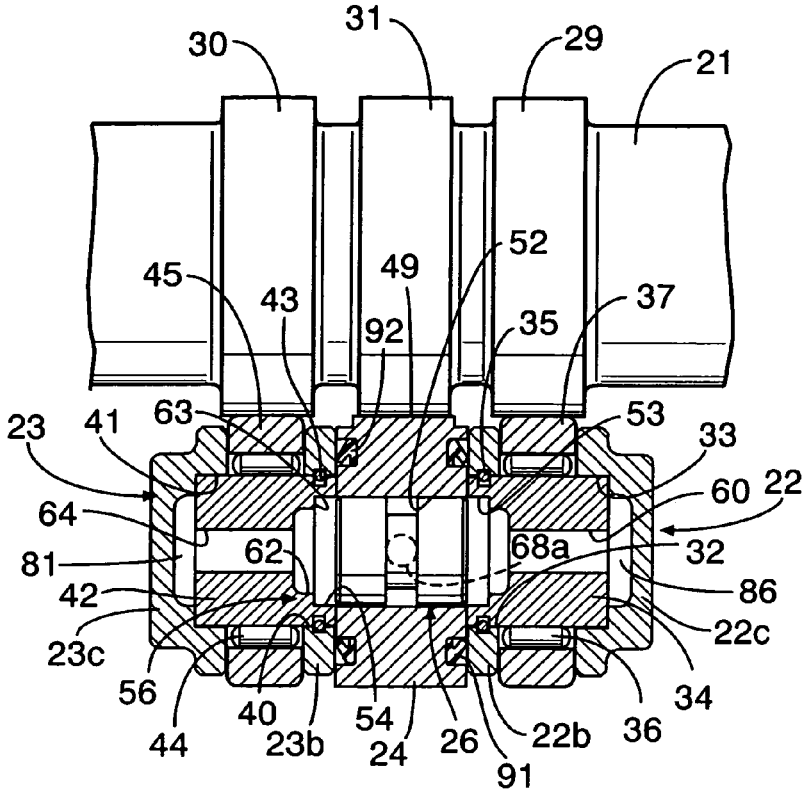
FIG. 3A is a view showing a section shown by the line 3-3 in FIG. 2 in a valve closed state.
Figure 3B:
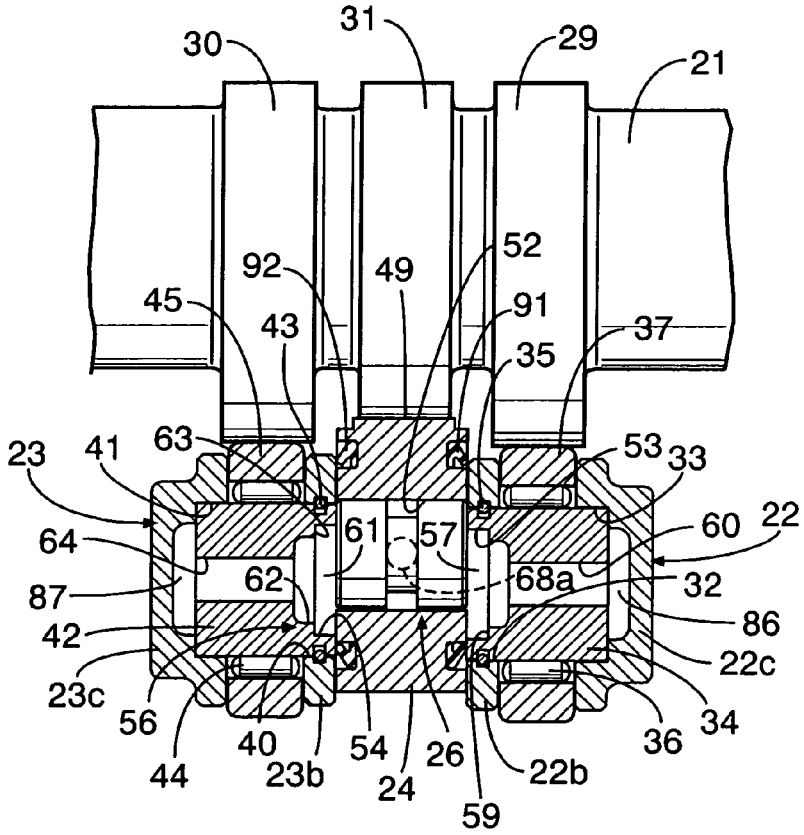
FIG. 3B is a view showing a section shown by the line 3-3 in FIG. 2 in a valve opening lift maximum state.

Referring to FIGS. 2 and 3 together, the valve operating system which drives both the intake valves 17 to open and close includes a camshaft 21 which is connected to and moved in synchronism with a crankshaft not shown at a speed reduction ratio of 1/2, a pair of first and a second free rocker arms 22, 23 capable of being free from both the intake valves 17, a drive rocker arm 24 which is connected to and moved in synchronism with both the intake valves 17 and is sandwiched between the first and second free rocker arms 22, 23, a rocker arm shaft 25 which has an axis parallel with the camshaft 21 and swingably supports each of the rocker arms 22 to 24 in common, and valve operating characteristics changing means 26 which is provided at the drive rocker arm 24 and the first and second free rocker arms 22, 23 so as to be able to change the operating characteristics of the intake valves 17 by switching the connection and the release of the connection of the drive rocker arm 24 to the first and second free rocker arms.

The camshaft 21 is rotatably supported by a cam holder 27 which is provided at the cylinder head 15, and a cap 28 which is fastened to the cam holder 27. The camshaft 21 is provided with first and second cams 29 and 30 individually corresponding to the first and second free rocker arms 22, 23, and a third cam 31 corresponding to the drive rocker arm 24.

The drive rocker arm 24 and the first and second free rocker arms 22, 23 which sandwich the drive rocker arm 24 therebetween are disposed between a pair of cam holders 27 and 27 so as to be swingably supported by the rocker arm shaft 25 which is supported by the cam holder 27 while sliding in contact with one another.

The first free rocker arm 22 integrally includes a cylindrical first support portion 22*a* which is swingably supported by the rocker arm shaft 25, a first inner support wall 22*b*, which extends to the side of one of the intake valves 17 from an inner end portion of the first support portion 22*a*, that is, the end portion at the drive rocker arm 24 side and has its outer surface in sliding contact with one surface of the drive rocker arm 24, and a first outer support wall 22*c* which extends to the side of one of the intake valves 17 from an intermediate portion in the axial direction of the first support portion 22*a*. An outer end of the first support portion 22*a* is in sliding contact with the cam holder 27.

A first support hole 32, which is parallel with the rocker arm 25, is provided in the first inner support wall 22*b* with its opposite ends open. A bottomed second support hole 33 having the same axis and the same diameter as the first support hole 32 is provided in the first outer support wall 22*c* to have a closed end at the side opposite from the drive rocker arm 24.

In the first and second support holes 32 and 33, a cylindrical first support shaft 34 is fitted until it abuts on the closed end of the second support hole 33, and an end surface of the first support shaft 34 at the drive rocker arm 24 side is flush with an outer surface of the first inner support wall 22*b*. In addition, a snap ring 35 for inhibiting removal of the first support shaft 34 from the first and second support holes 32 and 33 is fitted to an outer peripheral surface of the first support shaft 34 to be engaged with an inner surface of the first support hole 32.

A first roller 37 which is rotatably supported at the first support shaft 34 via a needle bearing 36 is disposed between the first inner support wall 22*b* and the first outer support wall 22*c*, and the first roller 37 is in rolling contact with the first cam 29 of the camshaft 21.

The second free rocker arm 23 integrally includes a cylindrical second support portion 23*a* which is swingably supported by the rocker arm shaft 25, a second inner support wall 23*b* which extends to the other intake valve 17 side from an inner end portion of the second support portion 23*a*, that is, the end portion at the drive rocker arm 24 side, and has its outer surface in sliding contact with the other surface of the drive rocker arm 24, and a second outer support wall 23*c* which extends to the other intake valve 17 side from an intermediate portion in the axial direction of the second support portion 23*a*. In addition, an outer end of the second support portion 23*a* is in sliding contact with the cam holder 27.

A third support hole 40, parallel with the rocker arm shaft 25, is provided in the second inner support wall 23*b* to open at opposite ends, and a bottomed fourth support hole 41 having the same axis and the same diameter as the third support hole 40 is provided in the second outer support wall 23*c* to have a closed end at the side opposite from the drive rocker arm 24.

In the third and the fourth support holes 40 and 41, a cylindrical second support shaft 42 is fitted until it abuts on the closed end of the fourth support hole 41, and an end surface of the second support shaft 42 at the drive rocker arm 24 side is flush with an outer surface of the second inner support wall 23*b*. In addition, a snap ring 43 for inhibiting removal of the second support shaft 42 from the third and the fourth support holes 40 and 41 is fitted to an outer peripheral surface of the second support shaft 42 to be engaged with an inner surface of the third support hole 40.

A second roller 45 which is rotatably supported at the second support shaft 42 via a needle bearing 44 is disposed between the second inner support wall 23*b* and the second outer support wall 23*c*, and the second roller 45 is in rolling contact with the second cam 30 of the camshaft 21.

The outer end side from the intermediate portion in the axial direction of the first support portion 22*a* in the first free rocker arm 22 is surrounded by a first torsion spring 46. One end of the first torsion spring 46 is engaged with the cam holder 27, and the other end of the first torsion spring 46 is engaged with the first free rocker arm 22. The first free rocker arm 22 is pivotally biased to the side to cause the first roller 37 to contact the first cam 29 by the spring force exerted by the first torsion spring 46.

The outer end side from the intermediate portion in the axial direction of the second support portion 23*a* in the second free rocker arm 23 is surrounded by a second torsion spring 47. One end of the second torsion spring 47 is engaged with the cam holder 27, and the other end of the second torsion spring 47 is engaged with the second free rocker arm 23. The second free rocker arm 23 is pivotally biased to the side to cause the second roller 45 to contact the second cam 30 by the spring force exerted by the second torsion spring 47.

The drive rocker arm 24 has a pair of arm portions 24*a* and 24*b* which extend to the first and second free rocker arms 22, 23 side and is formed to be substantially T-shaped in a plan view. Tappet screws 48 and 48 which abut on upper ends of the stems 17*a* in both the intake valves 17 are screwed into tip end portions of the arm portions 24*a* and 24*b* so as to make the advancing and retreating positions adjustable. In addition, a cam slipper 49 capable of sliding in contact with the third cam 31 is provided at the drive rocker arm 24.

The valve operating characteristics changing means 26 switches three states, that are the state in which the drive rocker arm 24 is not connected to any of the first and second free rocker arms 22, 23, and both the intake valves 17 are driven to open and close by the swing of the drive rocker arm 24 that follows the third cam 31, the state in which the drive rocker arm 24 is connected to the first free rocker arm 22, and thereby, both the intake valves 17 are driven to open and close by the drive rocker arm 24 that swings with the first free rocker arm 22 that follows the first cam 29, and the state in which the drive rocker arm 24 is connected to the second free rocker arm 23. Thereby, both the intake valves 17 are driven to open and close by the drive rocker arm 24 that swings with the second free rocker arm 23 that follows the second cam 30. The valve opening lift characteristics of both the intake valves 17 by the first to the third cams 29 to 31 are shown in FIG. 4.

Figure 4:
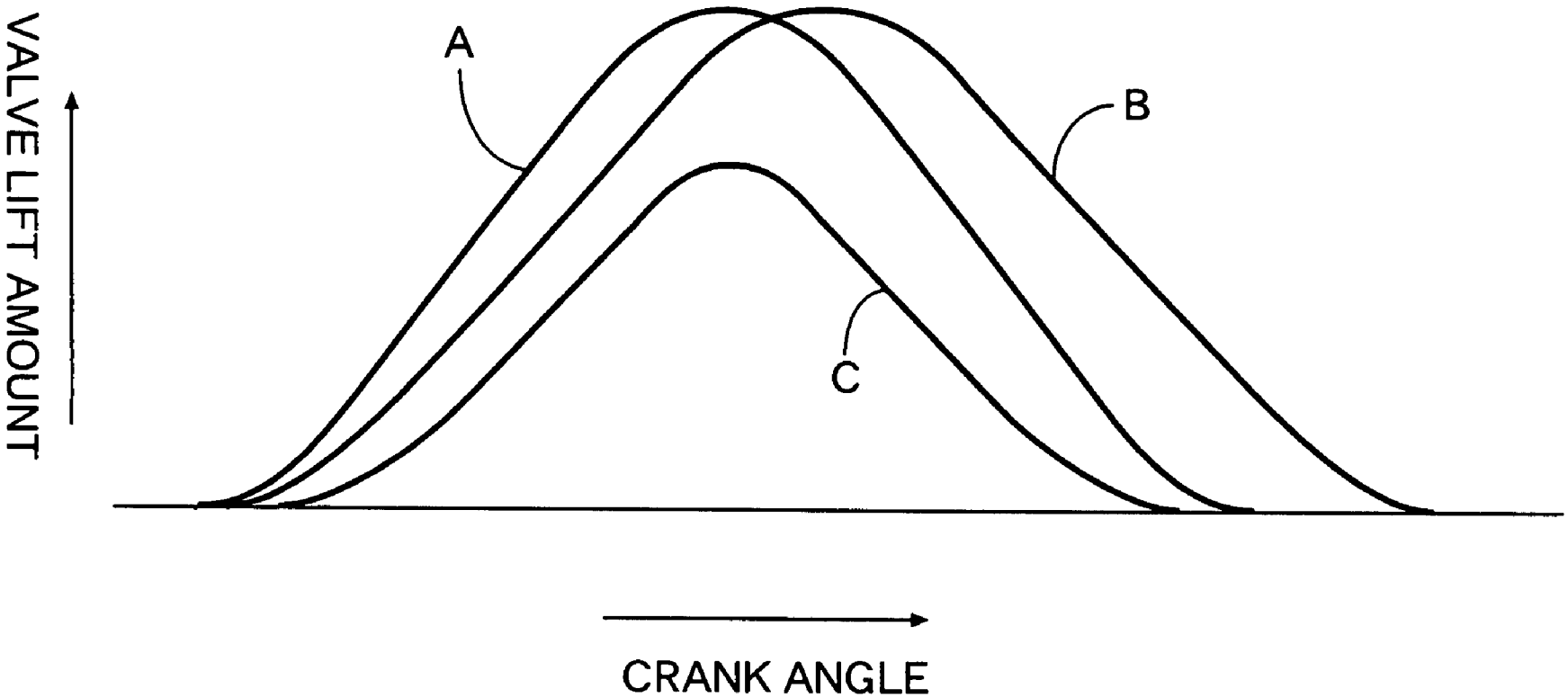
FIG. 4 is a diagram showing the valve operating characteristics.

In FIG. 4, the curve A represents the valve opening operating characteristic of the intake valves 17 by the first cam 29, the curve B represents the valve opening operating characteristic of the intake valves 17 by the second cam 30, and the curve C represents the valve opening operating characteristic of the intake valves 17 by the third cam 31.

The first to the third cams 29 to 31 respectively have base circular portions 29*a*, 30*a* and 31*a* each in an arc shape with the axis of the cam shaft 21 as a center, and high portions 29*b*, 30*b* and 31*b* which project outwardly in the diameter direction from the base circular portions 29*a* to 31*a* to be formed to differ in a cam profile from one another. The radius of each of the base circular portions 29*a* to 31*a* is set to be the same.

The third cam 31 corresponding to the drive rocker arm 24 has a cam profile which operates both the intake valves 17 to open and close in a low speed operation range of the engine. The height of the high portion 31*b* from the base circular portion 31*a* of the third cam 31 is set to be smaller than the heights of the high portions 29*b* and 30*b* from the base circular portions 29*a* and 30*a* of the first and second cams 29 and 30 individually corresponding to the first and second free rocker arms 22, 23 at the same crank angle.

The first and the second cams 29 and 30 are formed to have the portion where one of the heights of the high portions 29*b* and 30*b* from the base circular portions 29*a* and 30*a* becomes higher and the portion where the other one becomes higher in accordance with the change in the crank angle. The first cam 29 has a cam profile which operates both the intake valves 17 to open and close in the high speed operational range of the engine, and the second cam 30 has a cam profile which operates both the intake valves 17 to open and close in an Atkinson cycle.

The Atkinson cycle is the cycle in which compression ratio<expansion ratio, unlike the normal Otto cycle in which compression ratio=expansion ratio. The Atkinson cycle is characterized by making it possible to set the compression ratio and the expansion ratio individually. The second cam 30 delays the compression start timing by making the valve closing timing of the intake vales 17 later than the valve closing timing by the first cam 29. Thereby, the effective compression ratio is set to be lower than the expansion ratio. According to the operation of such an Atkinson cycle, thermal efficiency can be enhanced by thoroughly converting the expansion pressure into kinetic energy by setting the expansion ratio which controls the thermal efficiency to be high. Thus, knocking can be remedied by setting the effective compression ratio to be low.

As illustrated in FIG. 2, the valve operating characteristics changing means 26 has a pin 50 as a single connecting and operating member, which is provided in common at the drive rocker arm 24 and both the free rocker arms 22, 23 to be capable of switching the alternative connecting state of the driving rocker arm 24 to the first and second free rocker arms 22, 23, and the release state of the connection of the drive locker arm 24 to the first and second free rocker arms 22, 23. An operational restricting mechanism 51 is provided which engages with the pin 50 in the release state of the connection of the drive rocker arm 24 to the first and second free rocker arms 22, 23 to allow the state of holding the position of the pin 50, and for releasing the engagement with the pin 50 to allow for the operation of the pin 50.

In the drive rocker arm 24, an accommodation hole 52 with opposite ends opened to the first and second free rocker arm 22 and 23 is provided parallel with the rocker arm shaft 25 and the camshaft 21. The pin 50 is slidably fitted in the accommodation hole 52. The length of the pin 50 in the axial direction is set to be the same as the length of the accommodation hole 52 in the axial direction, and opposite end surfaces of the pin 50 are flush with opposite side surfaces of the drive rocker arm 24 in the state in which the pin 50 is not engaged with any of the first and second free rocker arms 22, 23.

In the first support shaft 34 of the first free rocker arm 22, a first engaging hole 53 is provided, which opens to an end surface of the first support shaft 34 at the drive rocker arm 24 side to make it possible to insert and engage one end of the pin 50 in the first engaging hole 53. The first engaging hole 53 has the same diameter as the accommodation hole 52. The first engaging hole 53 is provided in the first free rocker arm 22 to be coaxial with the accommodation hole 52 in the state in which both the intake valves 17 are closed and the first free rocker arm 22 abuts on the base circular portion 29*a* of the first cam 29.

In the second support shaft 42 of the second free rocker arm 23, a second engaging hole 54 is provided, which opens to an end surface of the second support shaft 42 at the drive rocker arm 24 side to make it possible to insert and engage the other end of the pin 50 in the second engaging hole 54. The second engaging hole 54 has the same diameter as the accommodation hole 52. The second engaging hole 54 is provided in the second free rocker arm 23 to be coaxial with the accommodation hole 52 in the state in which both the intake valves 17 are closed and the second free rocker arm 23 abuts on the base circular portion 30*a* of the second cam 30.

The first free rocker arm 22 is provided with a first operational force exerting part 55 capable of exerting on the pin 50 an axial operational force for driving the pin 50 to the second free rocker arm 23 side. The second free rocker arm 23 is provided with a second operational force exerting part 56 capable of exerting on the pin 50 an axial operational force for driving the pin 50 to the first free rocker arm 22 side against the axial operational force by the first operation force exerting part 55.

The first operational force exerting part 55 is constructed by forming a first hydraulic chamber 57 to which one end of the pin 50 facing inside the first support shaft 34 is provided for exerting a hydraulic force which drives the pin 50 to the second free rocker arm 23 side. In the first support shaft 34, a hydraulic chamber forming hole 58, which is formed to have a diameter smaller than the first engaging hole 53 to form the first hydraulic chamber 57 with the first engaging hole 53, is provided to be coaxially joined to the first engaging hole 53 while forming an annular step part 59, which faces the drive rocker arm 24 side between the hydraulic chamber forming hole 58 and the first engaging hole 53. In addition, an oil hole 60, which is smaller in diameter than the hydraulic chamber forming hole 58, is provided to be coaxially joined to the hydraulic chamber forming hole 58. The oil hole 60 opens to the end surface at the side opposite from the drive rocker arm 24 of the first support shaft 34.

The second operational force exerting part 56 is constructed by forming a second hydraulic chamber 61 to which the other end of the pin 50 facing inside the second support shaft 42 is provided for exerting a hydraulic force which drives the pin 50 to the first free rocker arm 22 side. In the second support shaft 42, a hydraulic chamber forming hole 62, which is formed to have a diameter smaller than the second engaging hole 54 to form the second hydraulic chamber 61 with the second engaging hole 54, is provided to be coaxially joined to the second engaging hole 54 while forming an annular step part 63 which faces the drive rocker arm 24 side between the hydraulic chamber forming hole 62 and the second engaging hole 54. An oil hole 64, which is smaller in diameter than the hydraulic chamber forming hole 62, is provided to be coaxially joined to the hydraulic chamber forming hole 62. The oil hole 64 opens to the end surface at the side opposite from the drive rocker arm 24 of the second support shaft 42.

Figure 5:
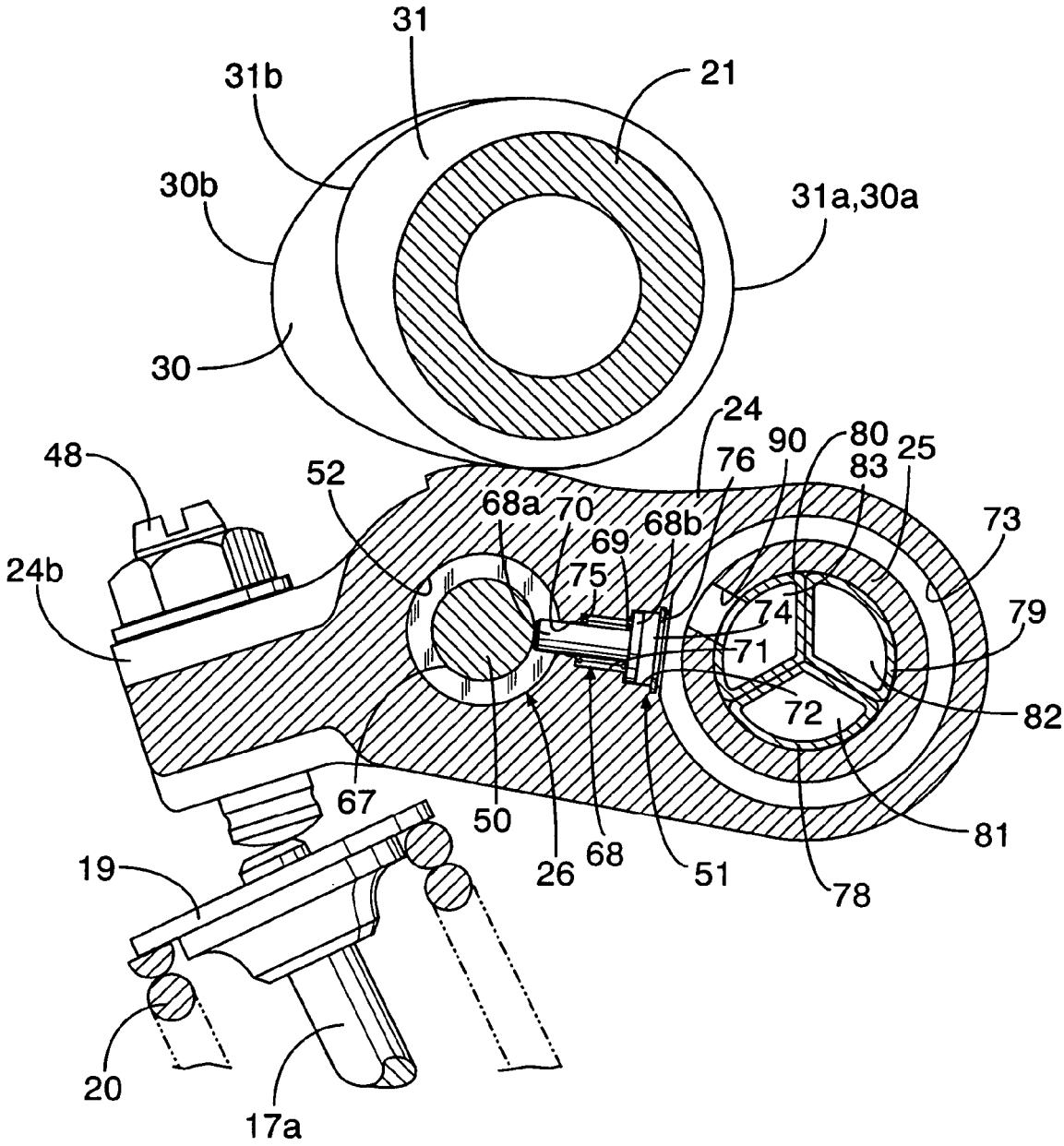
FIG. 5 is a sectional view taken along the line 5-5 in FIG. 2.

In FIG. 5, the operational restricting mechanism 51 includes an annular locking groove 67 which is provided on an outer periphery of a central portion in the axial direction of the pin 50, an engaging pin 68 which is slidably placed at the drive rocker arm 24 to be detachably engaged in the locking groove 67, and a return spring 69 which exerts a spring force which biases the engaging pin 68 to the side to release the engagement with the locking groove 67. The return spring 69 is provided under compression between the drive rocker arm 24 and the engaging pin 68.

In the drive rocker arm 24, a slide hole 70 with one end open to a central portion in the axial direction of the accommodation hole 52, a spring accommodation hole 71, which has a smaller diameter than the slide hole 70 and has one end axially joined to the other end of the slide hole 70, and a hydraulic chamber forming hole 72 which has a diameter larger than the spring accommodation hole 71 and has one end axially joined to the other end of the spring accommodation hole 71, are provided in sequence from the accommodation hole 52 side so that their axes are disposed on the line connecting the axes of the rocker arm shaft 25 and the accommodation hole 52. The other end of the hydraulic chamber forming hole 72 opens to an annular recessed part 73 which is provided at the drive rocker arm 24 so as to surround the rocker arm shaft 25.

The engaging pin 68 is constructed by coaxially and integrally connecting a central portion of one end surface of a disk-shaped pressure bearing portion 68*b*, which is slidably fitted in the hydraulic chamber forming hole 72, to the other end of an engaging shaft portion 68*a* which is slidably fitted in the sliding hole 70 with one end capable of being engaged in the locking groove 67. A third hydraulic chamber 74 to which the other end surface of the pressure bearing portion 68*b* is faced is formed inside the hydraulic chamber forming hole 72. The coil-shaped return spring 69 is provided under compression between an annular step part 75 which is formed between the slide hole 70 and the spring accommodation hole 71 and the pressure bearing portion 68*b* of the engaging pin 68 to surround the engaging shaft portion 68*a*. A snap ring 76, which inhibits removal of the engaging pin 68 to the annular recessed part 73 side by abutting on the pressure bearing portion 68*b* of the engaging pin 68, is fitted to the other end portion of the hydraulic chamber forming hole 72.

Figure 6:
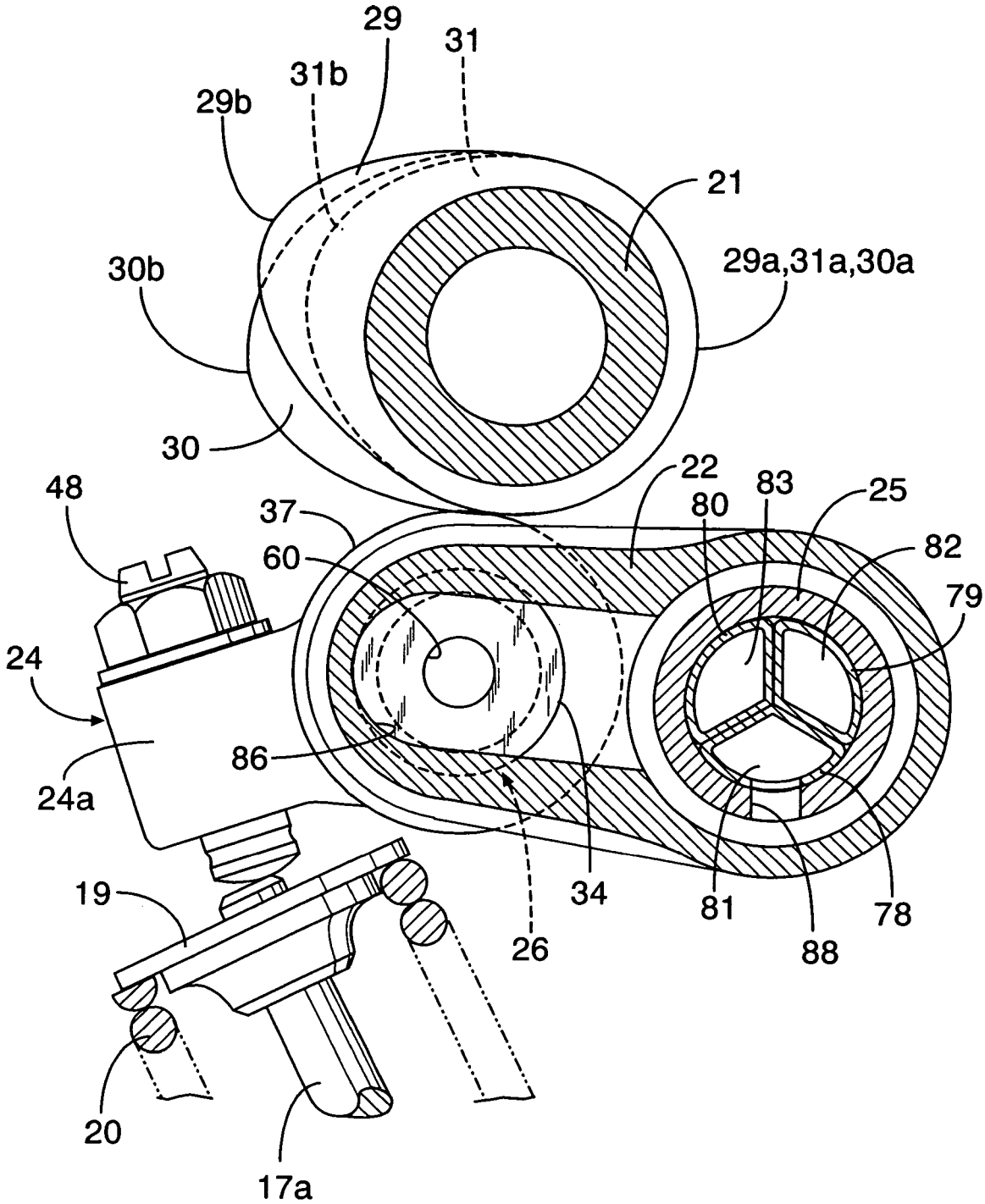
FIG. 6 is a sectional view taken along the line 6-6 in FIG. 2.

Referring also to FIG. 6, three tubular oil passage forming members 78, 79 and 80, which are molded so that their cross sectional shapes are substantially sectorial, are correctively fitted and fixed into the rocker arm shaft 25 so that the entire outer periphery becomes substantially circular in shape. A first, a second and a third oil passage 81, 82 and 83, to which an oil supply source is connected via a control valve not shown, are formed in the respective oil passage forming members 78 to 80. The operation/release of hydraulic pressure is controlled for each of the oil passages 81 to 83.

In the first free rocker arm 22, an annular recessed part 84, which surrounds the rocker arm shaft 25, is provided in an inner periphery of the first support portion 22*a* at the portion corresponding to the first outer support wall 22*c*. In the second free rocker arm 23, an annular recessed part 85 which surrounds the rocker arm shaft 25 is provided in an inner periphery of the second support portion 23*a* at the portion corresponding to the second outer support wall 23*c*. A communication passage 86, which allows the annular recessed part 84 to communicate with the oil hole 60, is provided in the first outer support wall 22*c* of the first free rocker arm 22. A communication passage 87, which allows the annular recessed part 85 to communicate with the oil hole 64, is provided in the second outer support wall 23*c* of the second free rocker arm 23. The communication passages 86 and 87 are each formed into a shape which has a narrow width in the direction along the axis of the rocker arm shaft 25 and has a vertically large width in the plane orthogonal to the axis of the rocker arm shaft 25 to enhance the oil passing performance. The passages are formed by using casting cores at the time of casting of the first and second free rocker arms 22, 23.

A communication hole 88, which allows the first oil passage 81 to communicate with the annular recessed part 84, is provided in the rocker arm shaft 25 and the passage forming member 78 at the portions corresponding to the annular recessed part 84. A communication hole 89, which allows the second oil passage 82 to communicate with the annular recessed part 85, is provided in the rocker arm shaft 25 and the passage forming member 79 at the portions corresponding to the annular recessed part 85. A communication hole 90, which allows the third oil passage 83 to communicate with the annular recessed part 73, is provided in the rocker arm shaft 25 and the passage forming member 80 at the portions corresponding to the annular recessed part 73. More specifically, the first oil passage 81 communicates with the first hydraulic chamber 57 of the first operation force exerting part 55, the second oil passage 82 communicates with the second hydraulic chamber 61 of the second operation force exerting part 56, and the third oil passage 83 communicates with the third hydraulic chamber 74 of the operation restricting mechanism 51.

A seal 91 is provided in an endless shape which is disposed to surround the whole of the accommodation hole 52 and the first engaging hole 53 irrespective of relative rotation of the drive rocker arm 24 and the first free rocker arm 22. A seal 92 is provided in an endless shape which is disposed to surround the whole of the accommodation hole 52 and the second engaging hole 54 irrespective of the relative rotation of the drive rocker arm 24 and the second free rocker arm 23 are fitted to opposite side surfaces of the drive rocker arm 24.

In such a valve operating system, in the low speed operational range of the engine, the engaging pin 68 is engaged in the locking groove 67 of the pin 50 of which opposite end surfaces are flush with the opposite side surfaces of the drive rocker arm 24 to cause the hydraulic pressure to act on the third hydraulic chamber 74, whereby movement of the pin 50 is restricted by the operational restricting mechanism 51, and the release state of the connection of the drive rocker arm 24 to the first and second free rocker arms 22, 23 is maintained. In this state, the drive rocker arm 24 follows the third cam 31 independently from the first and second free rocker arms 22, 23 with the first and second rollers 37 and 45 in contact with the first and second cams 29 and 30. Thus, the drive rocker arm 24 swings between the valve closing position shown in FIG. 3A and the valve opening position shown in FIG. 3B, so that a pair of intake valves 17 operate to open and close with the lift amount and opening and closing timings which are determined by the cam profile of the third cam 31.

At the time of the shift to the high speed operational range from the low speed operational range of the engine, the hydraulic pressure of the third hydraulic chamber 74 is released, and the hydraulic pressure is caused to act on the second hydraulic chamber 61. Then, as the engaging pin 68 is biased to the side to separate from the locking groove 67 of the pin 50, the engagement of the engaging pin 68 with the locking groove 67 is released, and the operational restricting mechanism 51 allows for the movement of the pin 50. Meanwhile, the pin 50 is biased to the first free rocker arm 22 side by the hydraulic force exerted by the second operational force exerting part 56. When the cam slipper 49 of the drive rocker arm 24 is in sliding contact with the base circular portion 31*a* of the third cam 31, and the first roller 37 of the first free rocker arm 22 contacts the base circular portion 29*a* of the first cam 29, whereby the accommodation hole 52 and the first engaging hole 53 become coaxial, one end portion of the pin 50 is inserted and engaged in the first engaging hole 53 until the one end portion abuts on the step part 59.

Figure 7A:
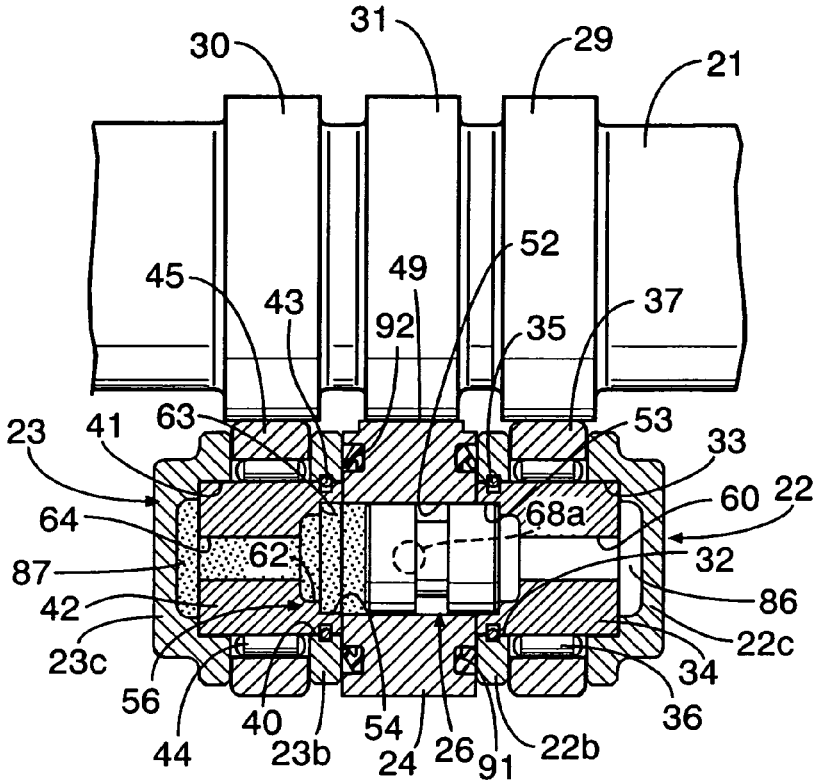
FIGS. 7A and 7B are sectional views corresponding to FIGS. 3A and 3B in the state in which the drive rocker arm is connected to one of the free rocker arms.
Figure 7B:
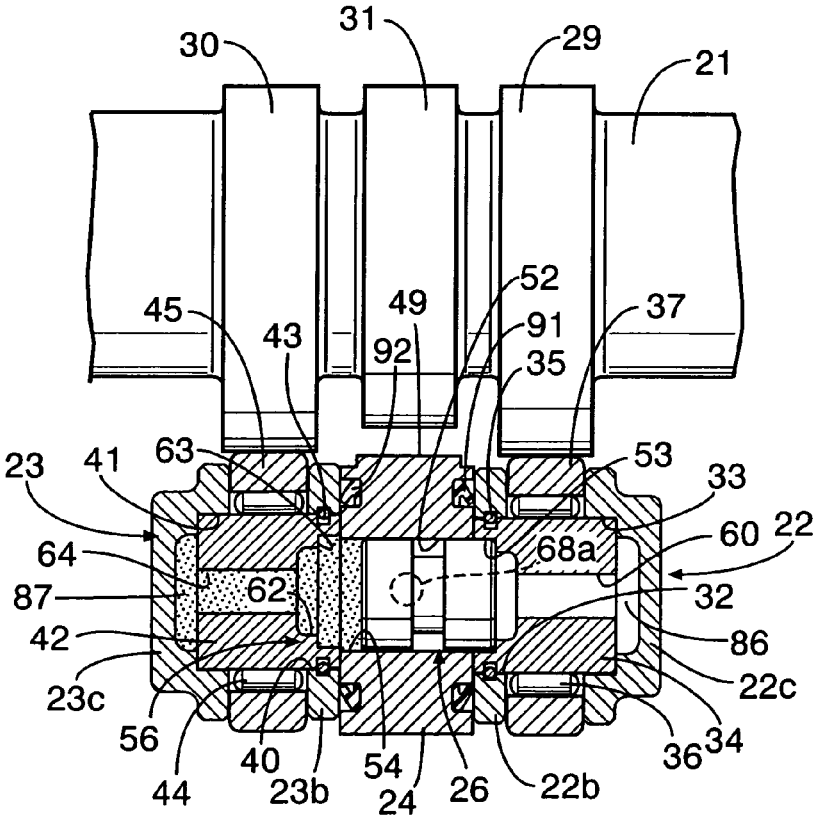

Thereby, the drive rocker arm 24 is engaged with and connected to the first free rocker arm 22, the drive rocker arm 24 swings between the valve closed position shown in FIG. 7A and the valve opening position shown in FIG. 7B with the first free rocker arm 22 which follows the first cam 29, and a pair of intake valves 17 operate to open and close with the lift amount and the opening and closing timings which are determined by the profile of the first cam 29.

At the time of the shift to the Atkinson cycle drive range from the high speed operational range of the engine, the hydraulic pressure of the second hydraulic chamber 61 is released and the hydraulic pressure acts on the first hydraulic chamber 57. Then, the pin 50 is biased to the second free rocker arm 22 side by the hydraulic force exerted by the first operational force exerting part 55, and when the accommodation hole 52 and the second engaging hole 54 become coaxial as the result that the first and second rollers 37 and 45 of the first and second free rocker arms 22, 23 contact the base circular portions 29*a* and 30*a* of the first and second cams 29 and 30, the other end portion of the pin 50 is inserted and engaged in the second engaging hole 54 until the other end portion abuts on the step part 63.

Figure 8A:
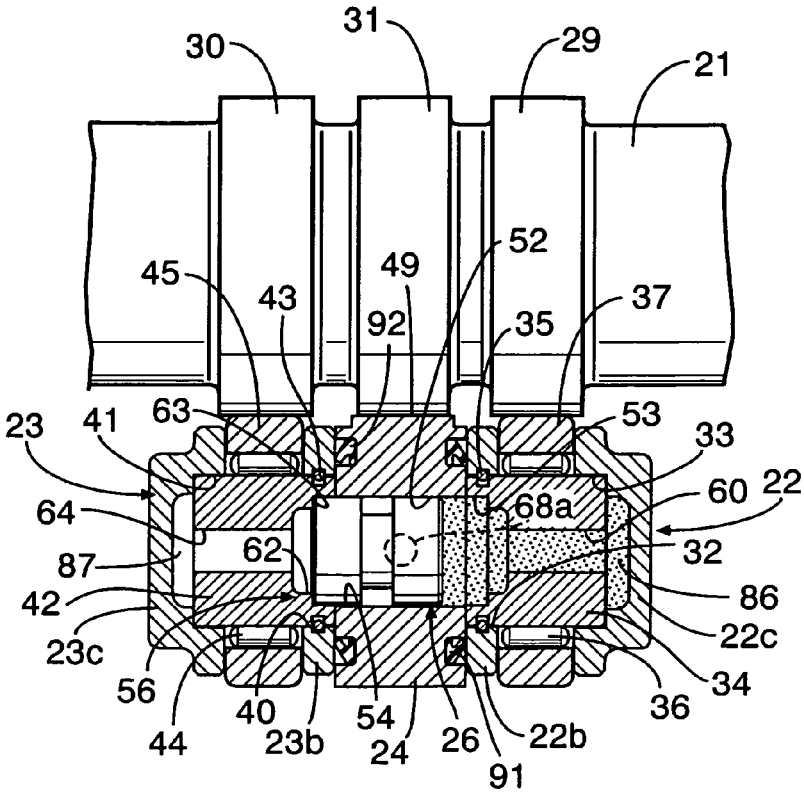
FIGS. 8A and 8B are sectional views corresponding to FIGS. 3A and 3B in a state in which the drive rocker arm is connected to the other free rocker arm.
Figure 8B:
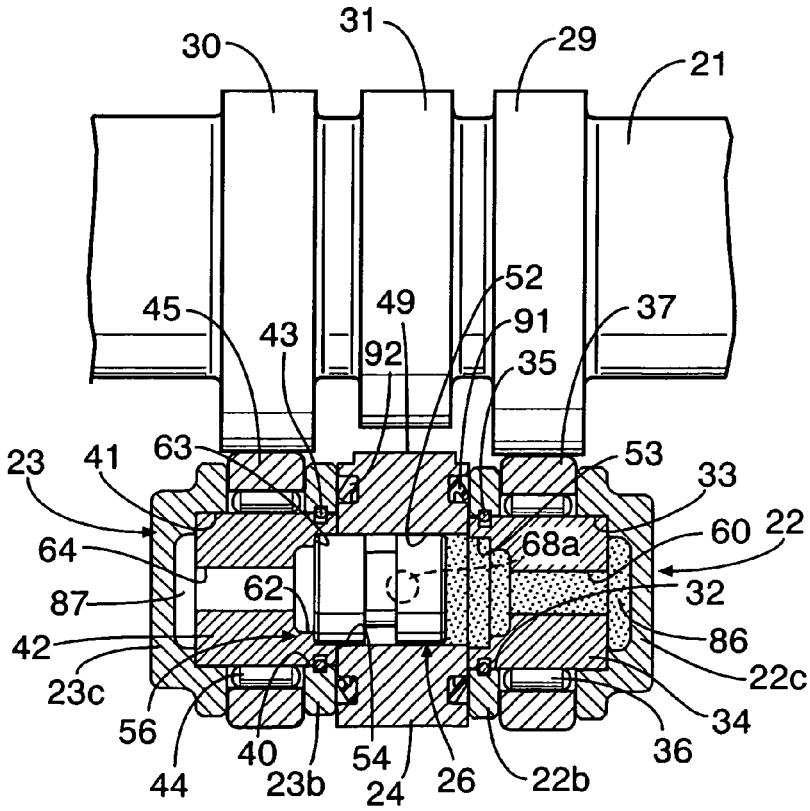

Thereby, the drive rocker arm 24 is engaged with and connected to the second free rocker arm 23, the drive rocker arm 24 swings between the valve closed position shown in FIG. 8A and the valve opening position shown in FIG. 8B with the second free rocker arm 23 which follows the second cam 30, and a pair of intake valves 17 operate to open and close with the lift amount and the opening and closing timings which are determined by the profile of the second cam 30.

At the time of shift to the low speed operational range from the high speed operational range of the engine or the Atkinson cycle operation range, the hydraulic pressure is caused to act on the third hydraulic chamber 74, the hydraulic pressure is caused to act on one of the first and second hydraulic chambers 57 and 61, and the hydraulic pressure of the other one is released. Then, the pin 50 moves to the accommodation hole 52 side from the first engaging hole 53 or the second engaging hole 54, and when the opposite end surfaces of the pin 50 are flush with the opposite side surfaces of the drive rocker arm 24, the engaging pin 68 engages with the locking groove 67, and the position of the pin 50 is maintained in the drive rocker arm 24.

In this manner, the alternative connecting state of the drive rocker arm 24 to the first and second free rocker arms 22, 23, and the release state of the connection of the drive rocker arm 24 to both the free rocker arms 22, 23 are switched by the operation of the single pin 50 which is common to the drive rocker arm 24 and both the free rocker arms 22, 23, and the operational restricting mechanism 51 switches the state holding the position of the pin 50 so as to maintain the release state of the connection of the drive rocker arm 24 to both the free rocker arms 22, 23, and the state allowing the operation of the pin 50.

Accordingly, it is possible to reliably switch the three states that are the state in which the drive rocker arm 24 is alternatively connected to both the free rocker arms 22, 23, and the state in which the connection of the drive rocker arm 24 to both the free rocker arms 22, 23 is released. In addition, it is not necessary to confirm the operation of the pin 50, and therefore, a delay does not occur in the switching time.

In the above described first embodiment, the third cam 31 corresponding to the drive rocker arm 24 has a cam profile corresponding to the low speed operational range. However, the third cam 31 may close and stop a pair of intake valves 17, and such valve closing and stopping of the intake valves 17 are effective in the case of stopping some cylinders among a plurality of cylinders.

Figure 9:
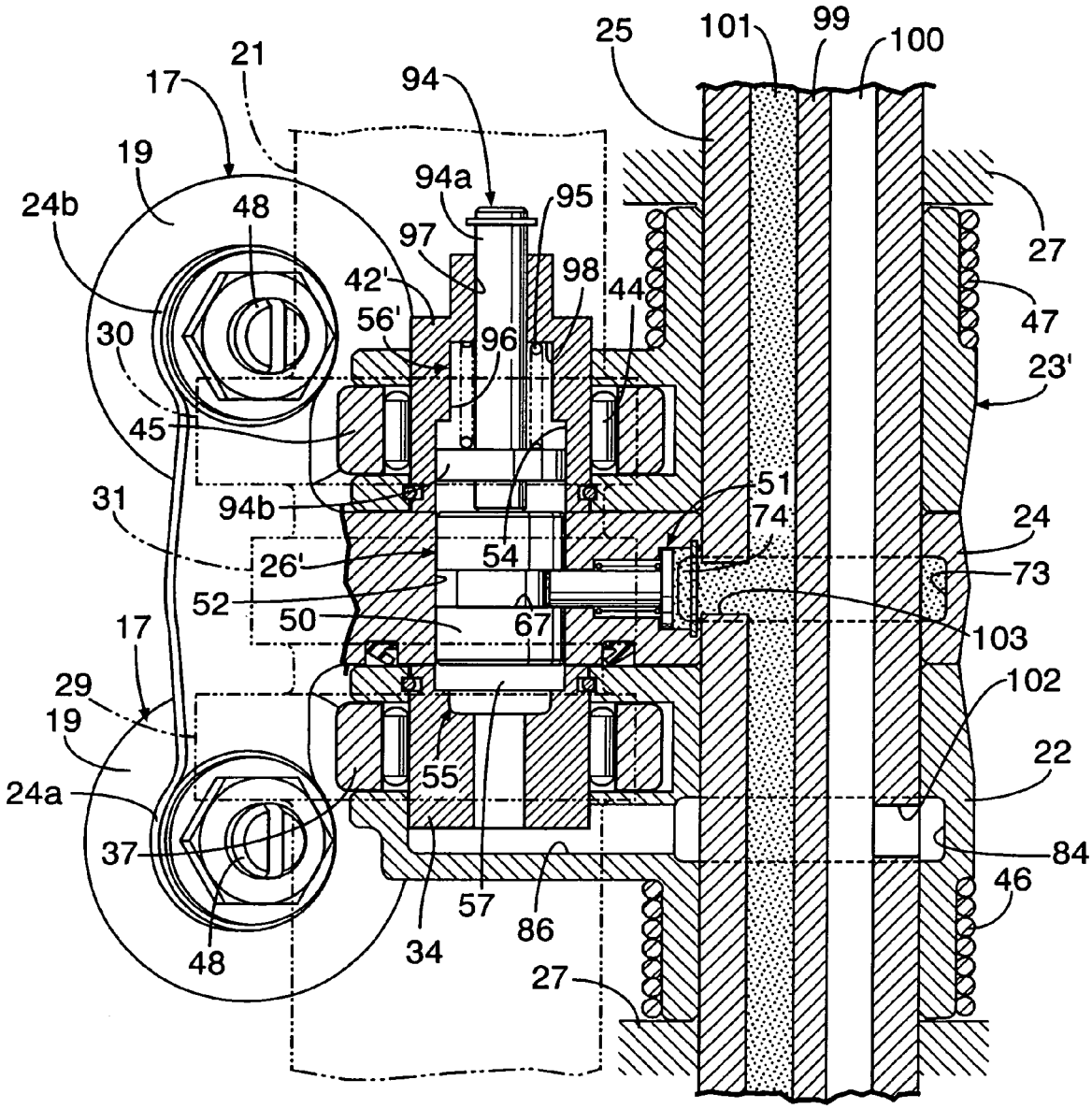
FIG. 9 is a sectional view corresponding to FIG. 2 of a second embodiment.

FIG. 9 shows a second embodiment of the present invention. The parts corresponding to those of the above described first embodiment are given the same reference numerals and symbols and are only shown in the drawings, and the detailed explanation will be omitted.

A pair of a first and a second free rocker arms 22, 23', and the drive rocker arm 24, which is linked and connected to both the intake valves 17, is sandwiched between the first and second free rocker arms 22, 23', and are swingably supported at the rocker arm shaft 25. The valve operating characteristics changing means 26' is provided at the drive rocker arm 24 and the first and second free rocker arms 22, 23' so as to be able to change the operational characteristics of the intake valves 17 by switching the connection of the drive rocker arm 24 to the first and second free rocker arms and release of the connection.

The first roller 37 is pivotally supported at the first free rocker arm 22 via the first support shaft 34 and the needle bearing 36, and the first free rocker arms 22 is biased to the side to bring the first roller 37 into rolling contact with the first cam 29 by the first torsion spring 46.

A second support shaft 42' is fitted and fixed to the second free rocker arm 23' so that the end portion at the side opposite from the drive rocker arm 24 projects from the second free rocker arm 23', and the second roller 45 is pivotally supported at the second free rocker arm 23' via the second support shaft 42' and the needle bearing 44. The second free rocker arm 23' is biased by the second torsion spring 47 to the side to bring the second roller 45 into rolling contact with the second cam 30.

The valve operating characteristics changing means 26' switches the three states that are the state in which the drive rocker arm 24 is not connected to any of the first and second free rocker arms 22, 23', and both the intake valves 17 are driven to open and close by the swing of the drive rocker arm 24 that follows the third cam 31, the state in which the drive rocker arm 24 is connected to the first free rocker arm 22, and thereby both the intake valves 17 are driven to open and close by the drive rocker arm 24 that swings with the first free rocker arm 22 that follows the first cam 29, and the state in which the drive rocker arm 24 is connected to the second free rocker arm 23', and thereby both the intake valves 17 are driven to open and close by the drive rocker arm 24 that swings with the second free rocker arm 23' that follows the second cam 30.

The valve operating characteristics changing means 26' has the pin 50 as a single connecting and operating member, which is provided in common at the drive rocker arm 24 and both the free rocker arms 22, 23' to be capable of switching an alternative connecting state of the drive rocker arm 24 to the first and second free rocker arms 22, 23', and the release state of the connection of the drive locker arm 24 to the first and second free rocker arms 22, 23', and an operational restricting mechanism 51 which engages with the pin 50 in the release state of the connection of the drive rocker arm 24 to the first and second free rocker arms 22, 23' to allow the state holding the position of the pin 50, and releases the engagement with the pin 50 to allow the operation of the pin 50.

In the first support shaft 34 of the first free rocker arm 22, a first engaging hole 53 is provided which makes it possible to insert and engage one end of the pin 50 in the first engaging hole 53. In the second support shaft 42' of the second free rocker arm 23', a second engaging hole 54 is provided which makes it possible to insert and engage the other end of the pin 50 in the second engaging hole 54.

The first free rocker arm 22 is provided with a first operational force exerting part 55 capable of exerting on the pin 50 an axial operational force for driving the pin 50 to the second free rocker arm 23' side, and the second free rocker arm 23' is provided with a second operational force exerting part 56' capable of exerting on the pin 50 an axial operation force for driving the pin 50 to the first free rocker arm 22 side against the axial operational force by the first operation force exerting part 55.

The second operational force exerting part 56' is constructed by a slide member 94 one end portion of which is in sliding contact with the other end surface of the pin 50, and a spring 95 which is provided under compression between the slide member 94 and the second support shaft 42', and exerts a spring force which drives the pin 50 to the first free rocker arm 22 side.

A spring accommodating hole 96, which is formed to be smaller in diameter than the second engaging hole 54, is coaxially joined to the second engaging hole 54. A slide hole 97, which is formed to be smaller in diameter than the spring accommodation hole 96, is coaxially joined to the spring accommodation hole 96. Both the spring accommodating hole 96 and the slider hole 97 are provided in the second support shaft 42'. The slide member 94 is integrally formed with a shaft portion 94*a* with one end abutting on the other end of the pin 50 and the other end side slidably fitted in the slide hole 97. A disk-shaped flange portion 94*b* projects outwardly in the radial direction from the shaft portion 94*a* to be slidably fitted in the second engaging hole 54, and the spring 95 is provided under compression between an annular step part 98 which is formed between the spring accommodating hole 96 and the slide hole 97 and the flange portion 94*b*.

The flange portion 94*b* is formed to project outwardly in the radial direction from the shaft portion 94*a* at the position where it is not inserted into the accommodation hole 52 of the drive rocker arm 24 even in the state in which one end of the pin 50 is inserted and engaged in the first engaging hole 53 of the first free rocker arm 22.

Oil passages 100 and 101 which are defined from each other by a partitioning member 99, which extends in the axial direction of the rocker arm shaft 25, are formed in the rocker arm shaft 25. One oil passage 100 communicates with the annular recessed part 84 which is provided in the first free rocker arm 22 via a communication hole 102 which is provided in the rocker arm 25, and the other oil passage 101 communicates with the annular recessed part 73 which is provided in the drive rocker arm 24 via a communication hole 103 which is provided in the rocker arm shaft 25.

According to the second embodiment, the same effect as in the first embodiment can be provided.

The embodiments of the present invention are described thus far, but the present invention is not limited to the above described embodiments, and various design changes can be made without departing from the present invention described in claims.

For example, in the above described embodiments, the intake valve 17 is taken and explained as an engine valve, but the present invention can be carried out in relation to an exhaust valve.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A valve operating system for an internal combustion engine comprising:

a pair of free rocker arms capable of swinging relative to each other and being free with respect to an engine valve, and a drive rocker arm which is linked and connected to the engine valve and sandwiched between both the free rocker arms are swingably supported at a rocker arm shaft which is common to both the free rocker arms and the drive rocker arm;

a camshaft which rotates around an axis parallel with the rocker arm shaft is provided with a plurality of cams including cams individually corresponding to both the free rocker arms by making cam profiles differ from each other; and the drive rocker arm and both the free rocker arms are provided with valve operating characteristics changing means capable of changing operational characteristics of the engine valve by switching a connection of the drive rocker arm to both the free rocker arms and release of the connection;

wherein the valve operating characteristics changing means comprises a single connection operating member which is provided in common at the drive rocker arm and both the free rocker arms to be capable of switching movement between an alternative connecting state of the drive rocker arm to either one of the free rocker arms and a release state of the connection of the drive rocker arm to the one free rocker arm, wherein a hydraulic pressure space is formed between the drive rocker arm and at least one of the pair of free rocker arms so as to extend in a direction of the switching movement of the single connection operating member, an end of the single connection operating member faces the hydraulic pressure space, a seal is provided between opposed faces of the driver rocker arm and the at least one free rocker arm to seal the hydraulic pressure space from an outside, and said single connection operating member is operated directly by a hydraulic pressure introduced into the hydraulic pressure space.

2. The valve operating system for an internal combustion engine according to claim 1, wherein a cam corresponding to the drive rocker arm is provided in the camshaft.

3. The valve operating system for an internal combustion engine according to claim 2, wherein the cam corresponding to the drive rocker arm is formed to bring the engine valve into a valve closing and stopping state in the release state of the connection of the drive rocker arm to both the free rocker arm.

4. The valve operating system for an internal combustion engine according to claim 2, wherein a height of the cam corresponding to the drive rocker arm from a base circular portion is set to be smaller than heights of the cams individually corresponding to both the free rocker arms from the base circular portions at a same crank angle.

5. A valve operating system for an internal combustion engine, comprising:

a pair of free rocker arms capable of swinging relative to each other and being free with respect to an engine valve, and a drive rocker arm which is linked and connected to the engine valve and sandwiched between both the free rocker arms are swingably supported at a rocker arm shaft which is common to both the free rocker arms and the drive rocker arm;

a camshaft which rotates around an axis parallel with the rocker arm shaft is provided with a plurality of cams including cams individually corresponding to both the free rocker arms by making cam profiles differ from each other; and the drive rocker arm and both the free rocker arms are provided with valve operating characteristics changing means capable of changing operational characteristics of the engine valve by switching a connection of the drive rocker arm to both the free rocker arms and release of the connection;

wherein the valve operating characteristics changing means comprises a single connection operating member which is provided in common at the drive rocker arm and both the free rocker arms to be capable of switching an alternative connecting state of the drive rocker arm to both of the free rocker arms and a release state of the connection of the drive rocker arm to both of the free rocker arms, further comprising an operational restricting mechanism that has an engaging member and switches a state in which the engaging member engages with the connection operating member in the release state of the connection of the drive rocker arm to both the free rocker arms to keep the position of the connection operating member, and a state in which the engaging member releases the engagement with the connection operating member to allow an operation of the connection operating member, wherein the engaging member is provided on the drive rocker arm.

6. The valve operating system for an internal combustion engine according to claim 5, wherein in the drive rocker arm, an accommodation hole which has opposite ends opened to both the free rocker arms and in which the connection operating member that is a pin is slidably fitted is provided parallel with the rocker arm shaft and the cam shaft; and engaging holes in which opposite ends of the connection operating member are capable of being engaged respectively are provided in both the free rocker arms so as to be coaxial with the accommodation hole in a state in which the engine valve is in a closed state and both the free rocker arms abut on base circular portions of the corresponding cams.

7. The valve operating system for an internal combustion engine according to claim 6, wherein operational force exerting parts capable of exerting an axial operational force in directions opposed to each other on the connection operating member are respectively provided in both the free rocker arms.

8. The valve operating system for an internal combustion engine according to claim 5, wherein lengths in an axial direction of the connection operating member and the accommodation hole are set to be the same.

9. The valve operating system for an internal combustion engine according to claim 8, wherein a cam corresponding to the drive rocker arm is provided in the camshaft.

10. The valve operating system for an internal combustion engine according to claim 8, wherein the cams individually corresponding to both the free rocker arms are formed to have a portion where one of heights of the cams from base circular portions becomes higher and a portion where the other one becomes higher in accordance with a change in the crank angle.

11. The valve operating system for an internal combustion engine according to claim 5, wherein a cam corresponding to the drive rocker arm is provided in the camshaft.

12. The valve operating system for an internal combustion engine according to claim 5, wherein the cams individually corresponding to both the free rocker arms are formed to have a portion where one of heights of the cams from base circular portions becomes higher and a portion where the other one becomes higher in accordance with a change in the crank angle.

13. The valve operating system for an internal combustion engine according to claim 5, wherein the engaging member engages with an annular locking groove of the connection operating member in the release state of the connection of the drive rocker arm to either one of the free rocker arms to keep the position of the connection operating member, and the state in which the engaging member releases the engagement with the annular locking groove of the connection operating member to allow an operation of the connection operating member.

14. A valve operating system for an internal combustion engine comprising:

a pair of free rocker arms capable of being free with respect to an engine valve, and a drive rocker arm which is linked and connected to the engine valve and sandwiched between both the free rocker arms are swingably supported at a rocker arm shaft which is common to both the free rocker arms and the drive rocker arm;

a camshaft which rotates around an axis parallel with the rocker arm shaft is provided with a plurality of cams including cams individually corresponding to both the free rocker arms by making cam profiles differ from each other; and the drive rocker arm and both the free rocker arms are provided with valve operating characteristics changing means capable of changing operational characteristics of the engine valve by switching a connection of the drive rocker arm to both the free rocker arms and release of the connection;

wherein the valve operating characteristics changing means comprises a single connection operating member which is provided in common at the drive rocker arm and both the free rocker arms to be capable of switching movement between an alternative connecting state of the drive rocker arm to either one of the free rocker arms and a release state of the connection of the drive rocker arm to the one free rocker arm, and wherein the cams individually corresponding to both the free rocker arms are formed to have a portion where one of heights of the cams from base circular portions becomes higher and a portion where the other one becomes higher in accordance with a change in the crank angle, wherein a hydraulic pressure space is formed between the drive rocker arm and at least one of the pair of free rocker arms so as to extend in a direction of the switching movement of the single connection operating member, an end of the single connection operating member faces the hydraulic pressure space, a seal is provided between opposed faces of the driver rocker arm and the at least one free rocker arm to seal the hydraulic pressure space from an outside, and said single connection operating member is operated directly by a hydraulic pressure introduced into the hydraulic pressure space.

15. A valve operating system for an internal combustion engine comprising:

a pair of free rocker arms capable of being free with respect to an engine valve, and a drive rocker arm which is linked and connected to the engine valve and sandwiched between both the free rocker arms are swingably supported at a rocker arm shaft which is common to both the free rocker arms and the drive rocker arm;

a camshaft which rotates around an axis parallel with the rocker arm shaft is provided with a plurality of cams including cams individually corresponding to both the free rocker arms by making cam profiles differ from each other; and the drive rocker arm and both the free rocker arms are provided with valve operating characteristics changing means capable of changing operational characteristics of the engine valve by switching a connection of the drive rocker arm to both the free rocker arms and release of the connection;

wherein the valve operating characteristics changing means comprises a single connection operating member which is provided in common at the drive rocker arm and both the free rocker arms to be capable of switching movement between an alternative connecting state of the drive rocker arm to either one of the free rocker arms and a release state of the connection of the drive rocker arm to the one free rocker arm; and wherein in the drive rocker arm, an accommodation hole which has opposite ends opened to both the free rocker arms and in which the connection operating member that is a pin is slidably fitted is provided parallel with the rocker arm shaft and the cam shaft; and engaging holes in which opposite ends of the connection operating member are capable of being engaged respectively are provided in both the free rocker arms so as to be coaxial with the accommodation hole in a state in which the engine valve is in a closed state and both the free rocker arms abut on base circular portions of the corresponding cams, wherein a hydraulic pressure space is formed between the accommodation hole of the drive rocker arm and at least one of the engaging holes so as to extend in a direction of the switching movement of the single connection operating member, an end of the single connection operating member faces the hydraulic pressure space, a seal is provided between opposed faces of the driver rocker arm and the at least one free rocker arm to seal the hydraulic pressure space from an outside, and said single connection operating member is operated directly by a hydraulic pressure introduced into the hydraulic pressure space.

16. The valve operating system for an internal combustion engine according to claim 15, wherein a spring member is provided in the other of said pair of free rocker arms so as to urge the drive rocker arm toward the one free rocker arm.

17. The valve operating system for an internal combustion engine according to claim 16, wherein lengths in an axial direction of the connection operating member and the accommodation hole are set to be the same.

18. The valve operating system for an internal combustion engine according to claim 15, wherein lengths in an axial direction of the connection operating member and the accommodation hole are set to be the same.

19. The valve operating system for an internal combustion engine according to claim 15, wherein a cam corresponding to the drive rocker arm is provided in the camshaft.

20. The valve operating system for an internal combustion engine according to claim 15, wherein the cams individually corresponding to both the free rocker arms are formed to have a portion where one of heights of the cams from base circular portions becomes higher and a portion where the other one becomes higher in accordance with a change in the crank angle.

21. A valve operating system for an internal combustion engine comprising:

a pair of free rocker arms capable of being free with respect to an engine valve, and a drive rocker arm which is linked and connected to the engine valve and sandwiched between both the free rocker arms are swingably supported at a rocker arm shaft which is common to both the free rocker arms and the drive rocker arm;

a camshaft which rotates around an axis parallel with the rocker arm shaft is provided with a plurality of cams including cams individually corresponding to both the free rocker arms by making cam profiles differ from each other; and the drive rocker arm and both the free rocker arms are provided with valve operating characteristics changing means capable of changing operational characteristics of the engine valve by switching a connection of the drive rocker arm to both the free rocker arms and release of the connection;

wherein the valve operating characteristics changing means comprises a single connection operating member which is provided in common at the drive rocker arm and both the free rocker arms to be capable of switching movement between an alterative connecting state of the drive rocker arm to either one of the free rocker arms and a release state of the connection of the drive rocker arm to the one free rocker arm; and wherein said connection operating member is slidably fitted in an accommodation hole which is provided in the drive rocker arm so as to have opposite ends opened to both the free rocker arms, said connection operating member having an axial length equal to that of the accommodation hole, wherein a hydraulic pressure space is formed between the drive rocker arm and at least one of the pair of free rocker arms so as to extend in a direction of the switching movement of the single connection operating member, an end of the single connection operating member faces the hydraulic pressure space, a seal is provided between opposed faces of the driver rocker arm and the at least one free rocker arm to seal the hydraulic pressure space from an outside, and said single connection operating member is operated directly by a hydraulic pressure introduced into the hydraulic pressure space.

22. A valve operating system for an internal combustion engine comprising:

a pair of free rocker arms capable of being free with respect to an engine valve and a drive rocker arm which is linked and connected to the engine valve and is between both the free rocker arms;

a rocker arm shaft which is common to both the free rocker arms and the drive rocker arm and swingably supporting the pair of free rocker arms and the drive rocker arm;

a camshaft which rotates around an axis parallel with the rocker arm shaft and including a plurality of cams including cams individually corresponding to both the free rocker arms by making cam profiles differ from each other;

an accommodation hole provided in the drive rocker arm and having opposite ends opened to both the free rocker arms; and a single piston slidably fitted in the accommodation hole and configured to slide in the accommodation hole to selectively assume a first state in which the piston does not engage either of the pair of free rocker arms such that the free rocker arms move independently from the drive rocker arm, in a second state in which the piston engages a first of the pair of free rocker arms such that the first free rocker arm moves together with the drive rocker arm, and a third state in which the piston engages a second of the pair of free rocker arms such that the second free rocker arm moves together with the drive rocker arm, wherein a hydraulic pressure space is formed between the drive rocker arm and at least one of the pair of free rocker arms so as to extend in a direction of movement of the single piston, an end of the single piston faces the hydraulic pressure space, a seal is provided between opposed faces of the driver rocker arm and the at least one free rocker arm to seal the hydraulic pressure space from an outside, and said single piston is operated directly by a hydraulic pressure introduced into the hydraulic pressure space.

23. The valve operating system for an internal combustion engine according to claim 22, wherein the piston slides in the accommodation hole via hydraulic forces.

* * * * *